US008684392B2

(12) United States Patent
Holzer et al.

(10) Patent No.: US 8,684,392 B2
(45) Date of Patent: Apr. 1, 2014

(54) SKI OR SNOWBOARD AND METHOD FOR THE PRODUCTION THEREOF

(75) Inventors: Helmut Holzer, St. Johann (AT); Georg Klausner, St. Johann (AT)

(73) Assignee: Atomic Austria GmbH (AT)

( * ) Notice: Subject to any disclaimer, the term of this patent is extended or adjusted under 35 U.S.C. 154(b) by 41 days.

(21) Appl. No.: 13/564,910

(22) Filed: Aug. 2, 2012

(65) Prior Publication Data

US 2013/0038041 A1 Feb. 14, 2013

(30) Foreign Application Priority Data

Aug. 11, 2011 (AT) ..... A 1158/2011

(51) Int. Cl.
*A63C 5/00* (2006.01)

(52) U.S. Cl.
USPC ..... 280/607; 280/609

(58) Field of Classification Search
USPC ..... 280/11.14, 601, 602, 607, 609, 610, 280/611
See application file for complete search history.

(56) References Cited

U.S. PATENT DOCUMENTS

| | | | | |
|---|---|---|---|---|
| 4,026,575 | A * | 5/1977 | Hartwig | 280/610 |
| 5,288,097 | A | 2/1994 | Pascal et al. | |
| 5,299,822 | A * | 4/1994 | Mayr et al. | 280/610 |
| 5,366,234 | A * | 11/1994 | Rohrmoser | 280/610 |
| 5,372,370 | A * | 12/1994 | Rohrmoser | 280/610 |
| 5,690,349 | A * | 11/1997 | Rohrmoser | 280/610 |
| 7,314,227 | B2 * | 1/2008 | Sanders | 280/602 |
| 7,396,036 | B2 * | 7/2008 | Barbieri et al. | 280/601 |
| 8,215,659 | B2 * | 7/2012 | Binder | 280/601 |
| 8,480,112 | B2 * | 7/2013 | Holzer et al. | 280/602 |
| 2011/0180201 | A1 | 7/2011 | Huber et al. | |

FOREIGN PATENT DOCUMENTS

| | | |
|---|---|---|
| AT | 407491 T | 9/2008 |
| AT | 11519 U1 | 12/2010 |
| DE | 3803483 A1 | 9/1988 |

* cited by examiner

*Primary Examiner* — John Walters
*Assistant Examiner* — James Triggs
(74) *Attorney, Agent, or Firm* — Lerner, David, Littenberg, Krumholz & Mentlik, LLP

(57) ABSTRACT

The invention relates to a ski or a snowboard, comprising a multilayered sliding board body comprising at least one strength-providing upper strap, at least one strength-providing lower strap, at least one strip-like core element arranged in between which is delimited essentially by a first and a second flat side and by lateral side surfaces, and which core element comprises at least in sections of its longitudinal extension an essentially trapezoidal cross section with a first base side with a first length and a second base side essentially parallel thereto with a second comparatively shorter length. Furthermore, the invention relates to a method for producing a prefabricated semi-finished product for the production of such a ski or snowboard, a suitably assembled semi-finished product, as well as a method for producing the ski or snowboard according to the invention by using the prefabricated semi-finished product.

24 Claims, 3 Drawing Sheets

SKI OR SNOWBOARD AND METHOD FOR THE PRODUCTION THEREOF

The invention relates to a ski or a snowboard, a method for the production of a prefabricated semi-finished product for the production of such a ski or snowboard, a suitably constructed semi-finished product, as well as a method for the production of the ski or snowboard of the invention by using the prefabricated semi-finished product, as indicated in claims 1, 11, 18 and 19.

Document AT 407 491 B of the same applicant describes a method for the production of a ski and a suitably constructed ski. In this case the said shell or cap structure is used, in that a preliminary shell is produced with a U-shaped cross section comprising an outer cover layer together with an impregnated reinforcing layer. After the production of said U-shaped shell a ski core is inserted between the sides thereof and plastic is inserted into the remaining intermediate spaces. Finally a ski body is produced in which the outer cover layer forms the upper side and the lateral longitudinal walls. The ski cores that are used and produced in preparation in addition to structural depressions or elevations on the top and bottom flat side have either an essentially rectangular cross section or an essentially trapezoidal cross section, whereby the trapezium shape of the ski core and the essentially trapezoidal cross sectional contour of the ski body are aligned identically or used with an identical orientation. Accordingly the longitudinal side walls of the ski core and the longitudinal side walls of the ski body run in relation to the cross section of the ski body either parallel to one another or are aligned at an angle to one another. The cross sectional width of the ski core tapers from the running surface coating in the direction of the upper cover surface of the ski body. This structure and said production method have proved advantageous for many applications, however the level of economic efficiency and processing stability that can be achieved is only satisfactory in some circumstances.

AT 11 519 U1, which is also of the same applicant, describes a further method for producing a ski or snowboard, in which the longitudinal side surfaces are formed at least partly by structurally independent side cheek elements. In this case a semi-finished product is produced in preparation which consists of the cover layer, the upper strap and at least one side cheek element of the subsequent ski or snowboard. In addition, the core element is attached adhesively to said prefabricated semi-finished product. Also in this production process a core element is used which has a substantially rectangular or trapezoidal cross-sectional contour in cross section and wherein a substantially trapezoidal cross-sectional contour of the ski or snowboard is aligned almost congruently or with same orientation as the substantially rectangular or trapezoidal cross-sectional contour of the core element. In addition, the reliability of the processing when forming the semi-finished product into a sliding board body, i.e. during the adhesive bonding of the semifinished product to the remaining components of the ski or snowboard to be produced, is only satisfactory in certain circumstances.

The objective of the present invention is to create a ski or snowboard or to provide a method for the production thereof, which enables a production process for creating a high-quality sliding board body which is as inexpensive as possible and is in perfect condition.

The objective of the invention is achieved firstly by the measures according to claim 1. Such a ski or such a snowboard comprises a multilayered sliding board body which meets the high requirements for quality and economic production. The core element, which broadens continuously or discontinuously in relation to the cross section of the multilayered sliding board body from the running surface coating in the direction of the upper cover layer, also has advantages specific to the production method which result in a relatively high and reliable product quality. In particular in this way the adhesion of the core element to the surrounding elements or layers is ensured as reliably as possible in terms of processing. In this way the rejection rates or number of poor quality products can be minimized. In particular mainly in connection with prefabricated semi-finished products a reliable filling of hollow spaces with the intended filler or adhesive is achieved, which is important for the quality and stability of the multilayered sliding board body. In addition, the production process of a suitably designed sliding board body can be optimized in terms of time and can run relatively error-free.

By means of the measures according to claim 2 a high filling level or high reliability of the filling can be achieved with regard to the intermediate spaces between the longitudinal side walls of the sliding board body and the closest respective side surfaces of the core element. In particular in this way also at relatively low injection pressures for the filler and adhesive relative to the corresponding intermediate spaces as far as possible an extensive filling of said intermediate spaces is ensured. In particular, in this way a kind of integral nozzle function is created by the respective components of the sliding board body, whereby the introduction of the filler and adhesive is also ensured in relatively narrow positions or positions relatively remote from the injection site. The corresponding structural measures thus result in the construction of high quality sliding board bodies, in which the risk of any unwanted reduction in strength or delamination is minimized.

Furthermore, the measures according to claim 3 are advantageous, as in thereby in addition to reliable filling or in addition to a high level of filling the intermediate space, which is wedge-shaped in cross section, with filler and adhesive also a strong, adhesive bonding of the at least one strip-like side cheek element to the sliding board body is ensured. In particular, in this way the achievable robustness is increased or in this way the probability of delamination or the detachment of the at least one side cheek element is minimized. Thus in this way high quality sliding board bodies are achieved which can be created relatively economically in terms of production technology.

The measures according to claim 4 are also advantageous, as in this way hollow cavities or air bubbles are eliminated in the sections of the sliding board body to be filled with filler and adhesive. In particular, in this way as far as possible the hollow or intermediate spaces are filled as completely as possible when the filler and adhesive is relatively viscous or relatively thick in its original flowing or processing state. In particular in this way pointed tapering niches in which cavities or air bubbles could form without filler and adhesive are much reduced or avoided.

By way of the measures according to claim 5 a higher filling level is achieved of the intermediate space which is essentially wedge-shaped in cross section. In this way the reliability or strength of the suitably adhesive bond is increased. In some circumstances in this way the time needed to completely fill the corresponding cavities that are wedge-shaped in cross section can be reduced. In particular, in this way a kind of nozzle effect is achieved which ensures the reliable filling of even relatively narrow gaps or cavities between the at least one strip-like side cheek element and the core element.

The measures according to claim 6 are also particularly advantageous, as in this way an improved, material-bonded or adhesive connection is formed between the at least one strip-like side cheek element and the core element. In particular in this way the thresholds relating to the delamination or detachment of elements are significantly raised, and robust and high-quality skis or snowboards can be produced. In addition, in this way the processing reliability is increased during the production of such a ski or snowboard. In particular, by means of said surface treatment or roughening on the one hand a material bond is formed and on the other hand to a certain extent a gripping or form-fitting connection is formed between the filler and adhesive and the corresponding surfaces of the at least one side cheek element and the core element.

The measures according to claim 7 are also advantageous, as in this way the simple and uncomplicated production of the sliding board body is achieved as far as possible. In addition, in this way the transmission of force relative to an edge element of the sliding board body is improved. Furthermore, in this way an intermediate space that is sufficiently wedge-shaped in cross section is ensured, which facilitates as far as possible complete filling with filler or adhesive.

By way of the measures according to claim 8 a sliding board body is created, the individual components of which are combined to make a very strong composite body, since the filler and adhesive ensures as far as possible a total or large area mutual adhesion of said elements or components.

In addition, by way of the measures according to claim 9 as far as possible a uniform and hollow cavity filling distribution of the originally flowable filler and adhesive is supported. In particular, in this way the strength-relevant lower strap is embedded as fully as possible into the filler and adhesive or with the one-sided introduction of the originally flowable filler and adhesive ensures as far as possible the complete integration of the metal band into the subsequently hardening filler and adhesive. The strength of the ski or snowboard and its product quality is thus improved further.

Also the embodiment according to claim 10 is an advantage as in this way a ski or snowboard is created which can withstand high stresses, in particular high loads, without being exposed to the risk of delamination between the individual layers or components. In addition, in this way the corresponding composite body can be assembled to be cost-efficient, in particularly rapidly and without complex measures in terms of production technology.

The objective of the invention is also achieved by way of a method for the production of a prefabricated semi-finished product according to claim 11. By means of the described allocation or alignment of the core element relative to the upper strap or the cover layer a semi-finished product is created which, during the subsequent completion or joining process to create the structurally completed or finished sliding board body, supports a reliable and robust manufacturing process. In particular, by means of the corresponding method a semi-finished product is produced which during the subsequent production or finishing process creates a good starting basis for a high-strength, adhesive bond with the other components necessary for the sliding board body.

The measures according to claim 12 are also an advantage as thereby a sliding board body can be created which comprises at least one structurally independent, strip-like side cheek element for delimiting at least one longitudinal side wall, whereby the corresponding method ensures a reliable connection or a very strong, material-bonded connection with the adjoining components of the semi-finished product or the subsequent sliding board body. In particular, in this way the quality of the semi-finished product or a subsequently formed sliding board body can be increased.

By means of the measures according to claim 13 as far as possible the corresponding cavities or intermediate spaces are filled as completely as possible when a relatively viscous filler or adhesive is used or if the corresponding injection pressure for the filler and adhesive are relatively low. In addition, in this way it is ensured with increased reliability that the at least one strip-like side cheek element adopts the intended alignment or orientation relative to the running surface coating or other outline contour of the sliding board body subsequently formed with this semi-finished product.

The measures according to claim 14 are also advantageous as thereby a high-strength, adhesive bond is achieved between the suitably roughened surfaces and the filler and adhesive in contact therewith. In particular, in this way mainly the corresponding side cheek elements are secured reliably and very stably to the subsequently formed sliding board body, whereby even with increased stresses or deflections on the sliding board body the probability of detachment or delamination is virtually excluded.

A particularly efficient and thorough method of roughening the corresponding surface sections is described in claim 15. In addition, also relatively inaccessible, intermediate spaces, which are essentially wedge or V-shaped in cross section, can be reached relatively easily and treated or roughened as intended. Furthermore, such measures are time-efficient and thorough.

By way of the measures according to claim 16 a tapering intermediate space or holding channel is created for the filler and adhesive, whereby the filling level or the filling reliability is increased.

The measures according to claim 17 are also advantageous as in this way deposits or stuck particles, which are introduced from a grinding or sandblasting method into the wedge-shaped intermediate space between the side cheek element and core element, can largely fall out of the intermediate space automatically or can be removed easily. In particular in this way in the pointed area of the wedge-shaped intermediate space unwanted accumulations of abrasive particles or particles which have been removed from the treated surfaces are avoided or reduced. The quality of the subsequent adhesion can be increased in this way. It is also achieved in this way that suitable molds for producing the semi-finished product do not have any sharp-edged cutting edges or pointed edges, whereby the lifetime of the corresponding molds is increased. In particular, obtuse edges or surface transitions in a mold are subject to much less wear than acute-angled transitions. However, also the improved removal of particles or sand from the intermediate space, which is wedge-shaped in cross section, facilitates the quality and production stability of a sliding board body to be assembled.

Claim 18 characterizes a semi-finished product, which forms an improved starting basis for completion into a sliding board body in the form of a ski or snowboard. The technical advantages and effects achievable in this way can be taken from the preceding and following parts of the description.

The objective of the invention is also achieved by means of a method according to claim 19. In this way a sliding board body is created which meets the requirements for high quality and can also be produced relatively inexpensively and economically. In particular, despite having a structurally, relatively complex structure the reliable and fault-free production of corresponding sliding board bodies can be achieved.

The measures according to claim 20 provide the advantage of a simple and yet very strong material-bonded connection of the prefabricated semi-finished products with the additional components of the sliding board body to be produced. A particular advantage is that no additional heat or thermal energy is supplied to the filler and adhesive or the joining process, whereby the cost or economic efficiency is significantly increased for the production of corresponding sliding board bodies.

Mainly by way of the measures according to claim 21 an energy-saving production process is achieved which achieves considerable ecological and economic advantages.

By way of the measures according to claim 22 on the one hand the processing cycle can be kept as short as possible as no heating or temperature stabilizing times needs to be adhered to. On the other hand a particularly inexpensive and ecologically improved production process is achieved in this way.

Furthermore, the measures according to claim 23 are an advantage as thereby the adhesively assembled composite body or the sliding board body to be produced can be demolded from the molds after a relatively short reaction or hardening period, so that relatively short production cycles or bonding cycles are achieved. In particular in this way a high clock speed can be achieved in relation to the charging of the pressing device or the molds with the sliding board bodies to be produced. The economic efficiency of the production process or the thereby produced sliding board bodies is thus improved.

Lastly, the measures according to claim 24 are a particular advantage, as in this way initially less stressable composite bodies gradually obtain their end stability or end strength, in that the latter are simply stored at room temperature or temporarily. The lack of stress and tension of the composite bodies guarantees in this way the intended, high-quality composite bodies or sliding board bodies, which after waiting for the hardening time or after achieving sufficient hardening of the filling and adhesive can be supplied easily to the respective finishing processes. The economic efficiency and quality of corresponding sliding board bodies is increased further in this way.

For a better understanding of the invention the latter is explained in more detail with reference to the following figures.

In a much simplified, schematic representation:

Figure 1:
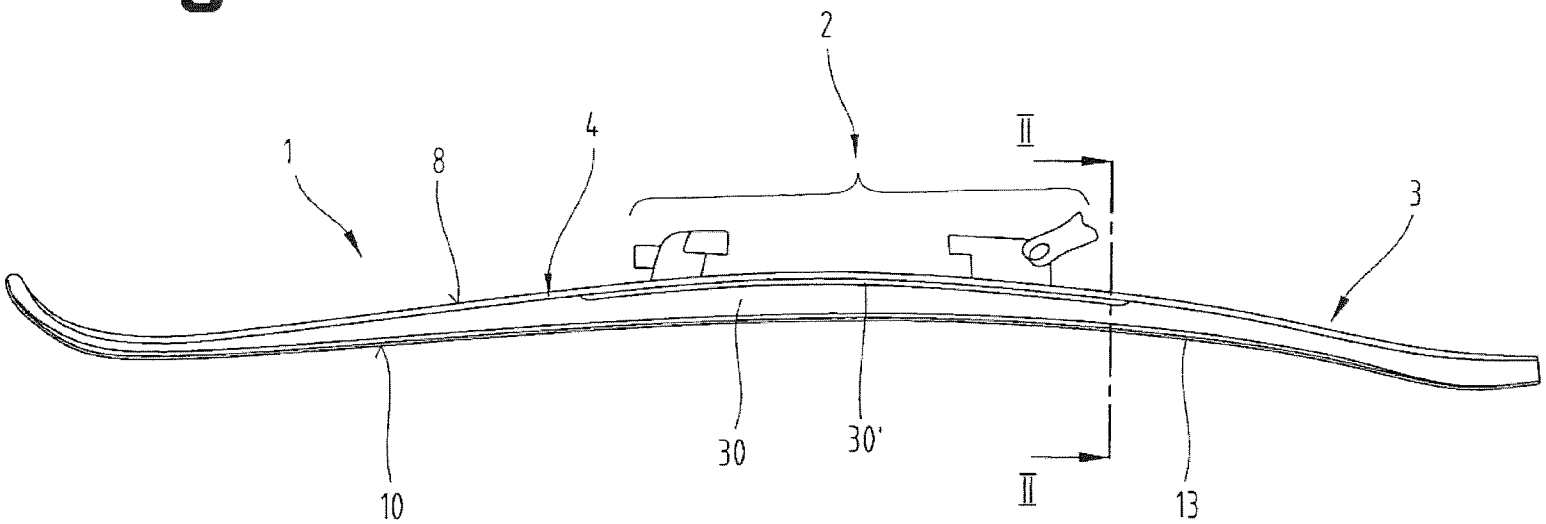
FIG. 1 shows an exemplary embodiment of a ski in side view.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

Figure 2:
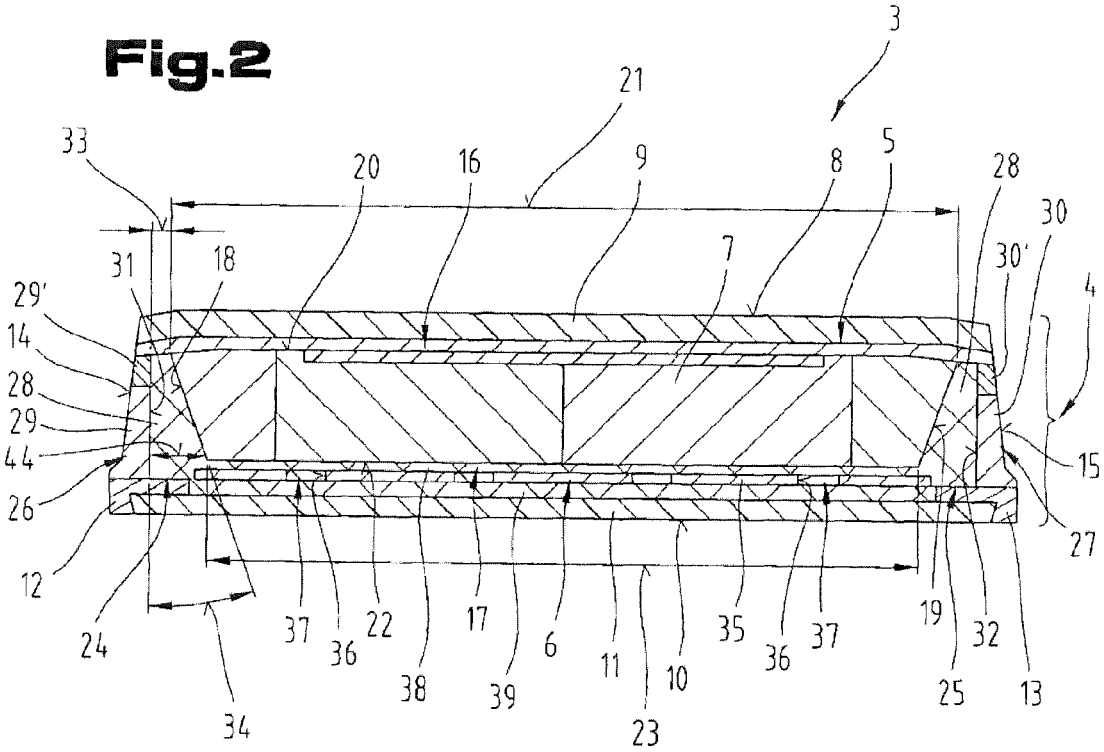
FIG. 2 shows a cross section of the ski according to FIG. 1, in cross section along the lines II-II in FIG. 1.

FIGS. 1, 2 show an improved embodiment of a ski 1 by way of example. Such a ski 1 is, as already known, used in pairs, wherein a binding device 2 is provided for connecting with and disconnecting from the foot or sports shoe of a user as necessary. As with a ski 1 it is also possible to apply the following measures to a so-called snowboard, whereby a snowboard is used singly by a user and both legs of the user can be secured to and released from the snowboard as necessary by bindings.

A corresponding ski 1 or snowboard comprises a multilayered sliding board body 3, which is provided for sliding on snow, ice or other surfaces. Said multilayered sliding board body 3 is thus a sandwich element or composite body 4 formed from a plurality of adhesively bonded elements.

Such a multilayered sliding board body 3 consists of at least one strength-providing upper strap 5, at least one strength-providing lower strap 6, at least one strip or board-like core element 7 arranged in between, at least one cover layer 9 forming the upper side 8 of the sliding board body 3 and at least one running surface coating 11 forming the lower side 10 of the sliding board body 3. In the case of the embodiment of a ski 1 or snowboard the lateral longitudinal edges of the running surface coating 11 are typically delimited by edge elements 12, 13 for the improved guiding of the sliding board body 3 on hard or icy ground. Said edge elements 12, 13 are usually made of metal materials and are known as steel edges in colloquial language.

The at least one one-piece running surface coating 11 composed possibly of several parts should be able to slide as well as possible and be resistant to wear on the respective ground surface, such as for example snow, ice or sand. The cover layer 9 has primarily a protective or decorative function for the sliding board body 3. The cover layer 9 is typically transparent or translucent and can be provided on the back with decoration, for example by means of sublimation printing or thermal color printing. Alternatively to or in combination with this on the rear side opposite the upper side 8 also a separate decorative layer or decoration substrate layer can be provided.

The upper strap 5 and the lower strap 6 are primarily strength and rigidity providing layers or elements in the sliding board body 3 and determine primarily its bending behavior or loadability and breaking resistance. The upper strap 5 and/or the lower strap 6 in this case do not need to be formed by independent layers or elements, but can also be defined by adhesives or fillers on the inside of the sliding board body 3. According to the shown exemplary embodiment the strength-providing upper strap 5 is formed by a metal layer, in particular a light metal. In a similar way the lower strap 6 is formed from a strip-like, metal element with a thickness of typically less than 1 mm. Alternatively to or in combination with this the upper strap 5 and/or the lower strap 6 can also be formed by so-called prepreg elements, which are typically formed by resin-impregnated fabric, in particular by fiber glass fabric. For example, the upper strap 5 extends over the entire, effective width of the sliding board body 3, so that its longitudinal side edges are visible or accessible in relation to the longitudinal side surfaces 14, 15 of the sliding board body 3.

As shown best from an overview of FIGS. 1, 2 the sliding board body 3 has at least in the assembly area of the binding unit 2 a cross section which is essentially trapezoidal, whereby the lower side 10 formed by the running surface coating 11 forms the comparatively longer base side of said trapezium contour, the upper side 8 defines the relatively short base side and the longitudinal side surfaces 14, 15 represent the lateral, inclined sides of the trapezoidal cross-sectional contour of the sliding board body 3.

The board or strip-like core element 7 arranged between the strength-relevant upper strap 5 and the strength-relevant lower strap 6 has at least in sections of its longitudinal extension an essentially trapezoidal cross section. Said trapezoidal cross section is provided at least within the assembly area of a binding device 2. Usually the core element 7 has an essentially trapezoidal cross section within 30% to 90% of its longitudinal extension. Such a core element 7 usually has its greatest strength or thickness in the middle longitudinal section and tapers progressively in the direction of the distal end sections. Mainly in opposite end sections the core element 7 can also have a rectangular cross section. It is advantageous if the core element 7 in its entire longitudinal extension has an almost trapezoidal cross section. Typically the length of the core element 7 is shorter than the nominal length of the subsequent sliding board body 3, whereby the length of the core element 7 can be about 10 cm to 30 cm, preferably about 20 cm, shorter than the nominal length of the sliding board body 3.

The strip-like or board-like core element 7 is delimited essentially by a first or upper flat side 16, by a second or lower flat side 17 and by lateral side surfaces 18, 19. The first and second flat side 16, 17 are aligned in relation to the cross section by the core element 7 essentially parallel to one another. At least one of the side surfaces 18, 19 is inclined relative to the flat sides 16, 17, so that the essentially trapezoidal cross section of the core element 7 is formed. The cross section is then also trapezoidal when a side surface 18 or 19 is aligned at right angles to the flat sides 16, 17 and the opposite side surface 19 or 18 is aligned at an acute or obtuse angle to the flat sides 16, 17.

The essentially trapezoidal cross-sectional contour of the core element 7 thus comprises a first base side 20 with a first length 21 and a second base side 22 essentially parallel thereto with a second comparatively shorter length 23. The flat sides 16, 17 can in this case be designed to be planar or flat or can also comprise grooving or elevations in order to achieve a close bond with fillers or adhesives. However, at least the greatest part or a middle, virtual plane of the delimiting or flat sides 16, 17 of the core element 7 are essentially parallel to one another, as shown by way of example in FIG. 2. At least one of the lateral side surfaces 18, 19 of the core element 7 is inclined at least within a section of the longitudinal extension of the core element 7, in particular at an obtuse or acute angle to the opposite flat sides 16, 17 or to the corresponding base sides 20, 22.

As can be taken by way of example from FIG. 2, the first flat side 16 of the core element 7 with the first base side 20, which is longer in cross section by comparison, is assigned closest to the strength-providing upper strap 5. The second flat side 17 of the core element 7, which in cross section forms the comparatively shorter, second base side 22, is assigned closest to the strength-providing lower strap 6. This means that the core element 7, which at least within part sections of its longitudinal extension has a trapezoidal cross section, is integrated virtually "standing on its head" into the sliding board body 3. In particular, the core element 7, which at least in the middle longitudinal section has an essentially trapezoidal cross-sectional contour, is inserted or placed offset to the outer, essentially trapezoidal cross-sectional contour of the sliding board body 3 in the sliding board body 3, as can be seen best in the exemplary representation according to FIG. 2.

Preferably, the core element 7 is made from a wooden material. In this way several wooden strips or wooden lamellae can be glued together to form a one-piece core element 7. The inclined, lateral side surfaces 18, 19 and possibly provided surface structures in the form of elevations or depressions on the upper and/or lower flat side 16, 17 are preferably formed by cutting processes. The core element 7 made of wood is preferably a prefabricated component, which during the manufacture of the sliding board body 3 is joined to the remaining components to form a one-piece composite body 4. Alternatively to a so-called wooden core it is also possible to provide a core element 7 made of plastic. A core element 7 of this kind can be configured as a hollow profile in order to have a mass that is as low as possible. A core element 7 made of plastic can also have a foam core, for example made of PU foam. Also such core elements 7 as an alternative to wood have at least within the middle longitudinal section an essentially trapezoidal cross section, where the core element 7 is integrated according to the preceding representations inversely to the outer essentially trapezoidal cross-sectional contour of the sliding board body 3 into the sliding board body 3.

This offset alignment of the trapezium shape of the core element 7 relative to the trapezium shape of the sliding board body 3 has production-technical and structural advantages, as explained in the introduction.

The opposite longitudinal side walls 26, 27 of the sliding board body 3 can be formed by this case by a cover layer 9 that is essentially C-shaped in cross section, wherein the lateral sides of the cover layer 9 that is essentially C-shaped in cross section form at least sections of the longitudinal side walls 26, 27. Such a construction is usually known as a "cap construction". As shown by way of example in FIG. 2 the longitudinal side walls 26, 27 can also be formed by structurally independent, strip-like side cheek elements 29, 30. Said side cheek elements 29, form the lateral closure of the sliding board body 3, in particular its longitudinal side walls 26, 27. Furthermore, it is possible to form the longitudinal side walls 26, 27 from a combination of side cheek elements 29, 30 and a cover layer 9 that is essentially U or C-shaped in cross section. In this case sections of the longitudinal side walls 26, 27 are formed by side cheek elements 29, 30 and by the said sections of a cover layer 9 that is essentially U-shaped in cross section. The embodiment shown in FIG. 2 is also advantageous in which structurally independent side cheek elements 29, 30 largely form the opposite longitudinal side walls 26, 27 of the sliding board body 3.

Figure 3:
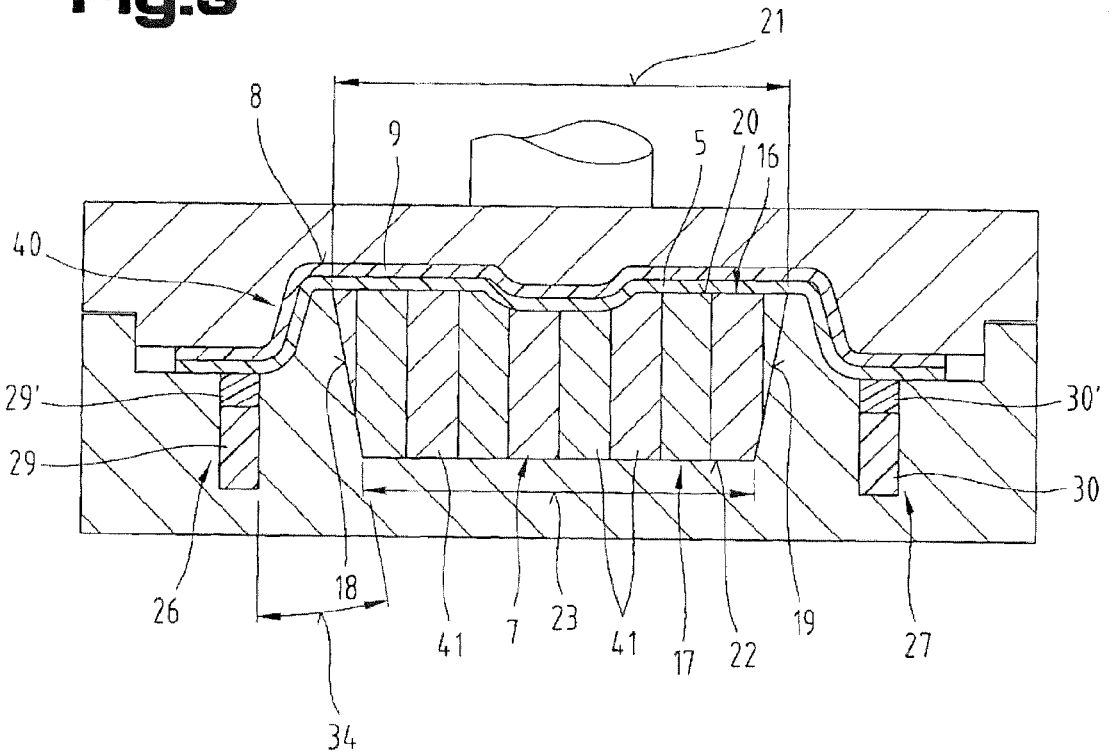
FIG. 3 shows a method step which illustrates the production of a prefabricated semi-finished product in combination with a core element and adjacent side cheek elements.
Figure 4:
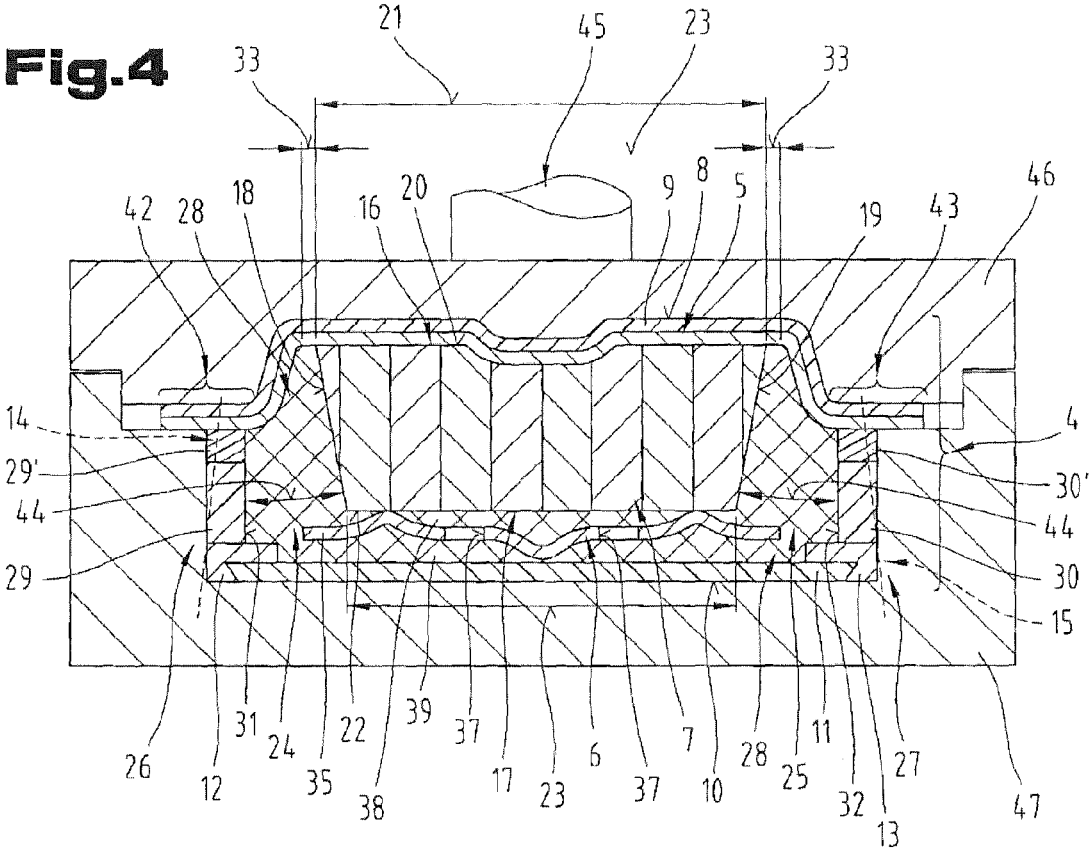
FIG. 4 shows the prefabricated and prepared semi-finished product according to FIG. 3 in a joining or pressing device during the connection with the remaining or additional components of the sliding board body to be produced.
Figure 5:
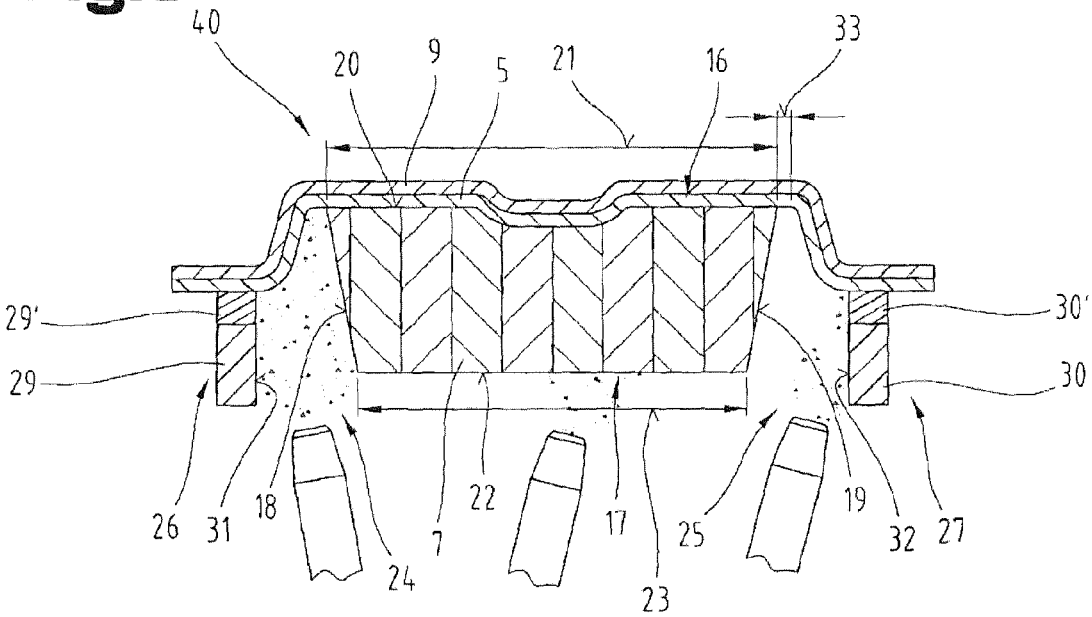
FIG. 5 shows the semi-finished product according to FIG. 3 during a treatment for roughening surface sections, in particular during a schematically represented sandblasting method.

According to an advantageous embodiment, as shown in FIGS. 3-5, at least one longitudinal side wall 26, 27 is formed by at least two side cheek elements 29, 29' or 30, 30' arranged above one another. The corresponding side cheek elements 29, 29' and 30, 30' are formed in this case to be strip or band-like and are preferably made of plastic. The side cheek elements 29, 29' or 30, 30' arranged accordingly above one another can have different height and length dimensions. Whereas the lower side cheek elements 29, 30 can extend over the most part of the longitudinal extension of the sliding board body 3, it is an advantage if the upper side cheek element 29', 30' extends only over a fraction of the length of the sliding board body 3, as shown best in FIG. 1. According to an advantageous embodiment the upper side cheek element 29', 30' preferably extends within the assembly area of the binding device 2. Preferably, the upper side cheek element 29', 30', which rests on the lower side cheek element 29, 30 is a load-transmitting manner, is made from an elastomeric plastic, whereas the lower side cheek element 29, 30 is preferably made from a hard plastic. The height extension of the at least one side cheek element 29, 29' or 30, 30' corresponds approximately to the vertical spacing between the upper strap 5 and the lower strap 6 or between the upper strap 5 and the lateral edge elements 12, 13 of the sliding board body 3.

According to an advantageous embodiment, as illustrated in FIG. 2, at least one part section of at least one longitudinal side wall 26, 27 of the sliding board body 3 is formed by at least one strip-like side cheek element 29, 29', 30, 30', the inner surface 31, 32 of which facing the core element 7 defines with the closest side surface 18, 19 of the core element 7 an intermediate space 24, 25 filled at least mostly with filler and adhesive 28. Said intermediate spaces 24, 25 opposite one another in relation to the width of the sliding board body 3 are thus filled with filler and adhesive 28, wherein they broaden from the upper strap 5 of the sliding board body 3 in the direction of its lower strap 6 in relation to the cross section of the sliding board body 3. The cross section of the intermediate spaces 24, 25 of the wedge embedded therein and finally hardened are formed by filler and adhesive 28 that is free-flowing in its original state is configured to be essentially A-shaped in cross section.

According to the exemplary embodiment shown in FIG. 2 it is advantageous if the inner surface 31, 32 of the at least one strip-like side cheek element 29, 29' or 30, 30' is aligned essentially at right angles to the surface of the running surface coating 11. The side cheek element 29, 30 is thus supported on an edge element 12, 13 in a load-transmitting manner.

According to an advantageous embodiment the intermediate space 24, 25, which is essentially wedge-shaped in cross section, and is filled at least mostly with the filler and adhesive 28, is designed in its upper end section closest to the upper strap 5 to be obtuse or flattened, in particular with a lowest cross-sectional width 33 of more than 0.5 mm, preferably between 0.5 and 5 mm, preferably about 1.5 mm.

It is expedient, if the inner surface 31, 32 of the longitudinal side wall 25, 26 and/or the inner surface 31, 32 of the strip-like side cheek element 29, 29', 30, 30' encloses with the closest side surface 18, 19 of the core element 7 a wedge-shaped angle 34 of between 5° and 30°, preferably of about 20°.

To achieve an improved material-bonded or adhesive connection with the filler and adhesive 28, it is an advantage to roughen the inner surfaces 31, 32 of the longitudinal side walls 26, 27 and the inner surfaces 31, 32 of the strip-like side cheek elements 29, 29', 30, 30' and the closest side surfaces 18, 19 of the core element 7 by means of a surface treatment, in particular by means of an abrasive surface treatment, before the said surfaces 31, 32; 18, 19 come into contact with the filler and adhesive 28. The corresponding roughening of said surfaces is performed advantageously by a sandblasting method, as illustrated schematically in FIG. 5.

The filler and adhesive 28, which preferably has a polyurethane base, connects the core element 7, the at least one strip-like side cheek element 29, 29', 30, 30', the at least one lower strap 6 and the at least one running surface coating 11 into a one-piece composite body 4. Furthermore, any edge elements 12, 13 formed are bonded adhesively by means of said filler and adhesive 28 into the one-piece composite body 4.

According to an advantageous embodiment the at least one lower strap 6 is formed by a metal band 35. Said band 35 preferably comprises a plurality of openings 36 distributed as shown schematically in FIGS. 2, 4. Said openings 36 are connecting channels 37 between the layers 38, 39 lying above and below the metal band 35 of filler and adhesive 28. Said connecting channels 37 are at least partly filled with the filler and adhesive 28, so that they connect the layers 38, 39 of filler and adhesive above and below the band 35 in one piece. The openings 36 represent transfer channels during the production process, so that an intensive embedding of the perforated band 35 into the filler and adhesive 28 is ensured.

FIG. 3 shows schematically a central method during the production of a prefabricated semi-finished product 40. Such a preprepared semi-finished product 40 represents a component for the production of a ski 1 or snowboard illustrated in FIG. 1.

Said semi-finished product 40 is configured as a multi-component, one-piece part component, which comprises at least the cover layer 9, at least part of the strength-providing upper strap 5 and at least one core element 7 of a subsequent sliding board body 3 connected by material bonding or adhesively with the lower side of the strength-providing upper strap 5. The upper strap 5 can comprise for example a so-called prepreg, which under the effect of temperature and pressure ensures an adhesive connection of the upper, first flat side 16 of the core element 7 with the upper strap 5 or with the cover layer 9.

The corresponding core element 7 is configured to be strip-like or board-like and extends over about 70% to 95%, preferably over about 85% of the nominal length of the sliding board body to be produced. The core element 7, which is formed for example by several wooden lamellae 41 glued together to form a one-piece body, has an outline contour which is essentially trapezoidal in cross section. Taken into consideration as a body, the core element 7 thus has a first and second flat side 16, 17, which are aligned as seen in cross section essentially parallel to one another and are delimited by two lateral side surfaces 18, 19, whereby at least one side surface 18 or 19 is inclined, that is aligned at an angle deviating from a right angle from the flat sides 16, 17. In those sections of the longitudinal extension of the core element 7, where there is a trapezoidal cross section, the cross-sectional contour thus has a first base side 20 with a first width respectively length 21 and a second base side 22 essentially parallel thereto with a second, comparatively shorter width respectively length 23.

It is essential here that during the production of the semi-finished product 40, as illustrated by way of example in FIG. 3, the core element 7, that is trapezoidal in cross section, is connected to the lower side of the strength-providing upper strap 5 or the cover layer 5 by material bonding or adhesion, such that the first flat side 16 of the core element 7 with the base side 20, that is comparatively longer in cross section, is assigned closest to the strength-providing upper strap 5, whereby the lower side of the core element 7 facing away from the strength-providing upper strap 5 is formed by the second flat side 17 of the core element 7 with the base side 22 that is comparatively shorter in cross section. Consequently, the core element 7 is placed into the semi-finished product 40 such that its cross-sectional width tapers from the cover layer 9 in the direction of the subsequent running surface coating 11 of the sliding board body 3 to be produced, in particular narrows continuously or discontinuously, as can also be seen from an overview of FIGS. 2, 3.

According to an advantageous measure the preprepared semi-finished product 40 also comprises at least one strip-like side cheek element 29, 29', 30, 30' which, prior to the joining of or prior to the completion of the semi-finished product 40 with the additional or completing components of the final sliding board body 3, is an additional component of the prefabricated semi-finished product 40. Said at least one strip-like side cheek element 29, 29', 30, 30', which forms or form at least one part of at least one longitudinal side wall 26, 27 of the final sliding board body 3, are adhered in this case to at least one longitudinal side edge 42, 43 of the cover layer 9 or to the upper strap 5 arranged on the lower side of the cover layer 9, as can be taken mainly from the schematic representation according to FIG. 3. A process of adhesion of this kind can for example be implemented during a hot pressing process or cold adhesion process.

During the joining or adhesive bonding of at least one strip-like side cheek element 29, 29', 30, 30' to the lower side of the upper strap 5 or the cover layer 9 a wedge shaped intermediate space 24, 25, which is essentially wedge-shaped in cross section, is formed in relation to the core element 7, which is filled at least mostly with filler and adhesive 28 during the subsequent completion of the semi-finished product 40 into a sliding board body, as shown in an overview of FIGS. 3, 4. Said wedge-shaped intermediate space 24, 25 which is filled with filler and adhesive 28 is delimited in relation to the width of the sliding board body 3 essentially by the inner surface 31, 32 of the at least one strip-like side cheek element 29, 29', 30, 30' facing the core element 7 and by the closest, inclined side surface 18, 19 of the core element 7, as shown best from FIG. 4. Consequently, a cross-sectional width 33, 44 of the intermediate space 24, 25 which is essentially wedge-shaped in cross section is increasing larger from an end section closest to the upper strap 5 in the direction of an end section closest to the lower strap 6. This is achieved primarily by the inclined side surfaces 18, 19 of the core element 7, but can be increased in addition also by the suitably inclined inner surfaces 31, 32 of the longitudinal side walls 26, 27.

As shown schematically mainly in FIGS. 2, 4 it is advantageous to define the smallest cross-sectional width 33 of the intermediate space 24, 25 which is wedge-shaped in cross section in its end section closest to the upper strap 5 to be more than 0.5 mm, preferably between 0.5 mm and 5 mm, preferably about 1.5 mm.

As shown schematically in FIG. 5, it is an advantage to roughen at least the lateral delimiting surfaces of the wedge-shaped intermediate space 24, 25 provided for filling with filler and adhesive 28, in particular the inner surfaces 31, 32 of the at least one strip-like side cheek element 29, 29', 30, 30' and the respectively closest facing side surfaces 18, 19 of the core element 7 on their surfaces, before said intermediate spaces 24, 25 are filled with the filler and adhesive 28 that flows freely in its original state. As shown schematically in FIG. 5 it is particularly advantageous to perform this roughening of the corresponding surfaces, which are to come into contact with the filler and adhesive 28, by means of an abrasive treatment method. It is advantageous in particular to use a sandblasting method for this. As already known, abrasive particles, for example grains of sand or other abrasive particles, are directed by compressed air against the surfaces to be roughened. In this way, mainly when using a wooden core 7 and longitudinal side walls 26, 27 made of plastic, an improved, in particular a high-strength and reliable, adhesive bond can be achieved between the core element 7 and the filler and adhesive 28 which is relatively free-flowing and low viscosity in its original state.

A prefabricated semi-finished product 40, as illustrated by way of example in FIG. 5, is joined in a following method step with the additional components necessary for the subsequent sliding board body 3, such as the running surface coating 11, the strength-providing lower strap 6 and possibly edge elements 12, 13, as illustrated in FIG. 4. In such a joining and production process for the sliding board body 3, such as a ski 1 or a snowboard, the prefabricated semi-finished product 40 according to FIG. 5 is joined adhesively to the remaining components. In this case the previously described semi-finished product 40, which was produced or assembled according to the above explanations, was joined by means of a pressing device 45 and at least one mold 46, 47 in at least one subsequent or separate pressing cycle to the additional, completing components of the sliding board body 3 to be produced, such as its running surface coating 11, its strength-providing lower strap 6 and possibly provided edge elements 12, 13. Said adhesive bond is preferably performed by means of a filler and adhesive 28 with a polyurethane base which reacts or hardens sufficiently rapidly at room temperature, in particular finally hardens at room temperature. During the joining process said relatively fluid filler and adhesive 28 with high fluidity according to FIG. 4 can in this case also reach and fill the smallest intermediate spaces sufficiently well and rapidly. The wedge shape of the intermediate spaces 24, 25 between the side surfaces 18, 19 of the core element and the inner surfaces 31, 32 of the longitudinal side walls 26, 27 thus facilitates as far as possible a high filling level of said intermediate spaces 24, 25.

More expediently the joining or pressing cycle shown very schematically in FIG. 4 is configured for the adhesive bonding of the semi-finished product 40 with the additional components of the sliding board body 3 to be produced as a cold pressing cycle. This means that during said adhesive joining process preferably no additional or no external energy is provided for the joining process. The chemical reaction alone, occurring at room temperature of the filler and adhesive 28 with a polyurethane base, for example Modipur®, is sufficient to achieve an adequate joining or adhesion process.

The filler and adhesive 28, which is preferably based on polyurethane, is formed by a two-component mixture of a polyol and isocyanate which is free-flowing or runny in a processing state and hardens at room temperature. Said components are mixed shortly before processing and mixed during the processing and by using an injection process (RIM) are introduced into the shaping molds 46, 47—FIG. 4—and pressed between the individual layers of the composite body 4 to be produced.

The filler and adhesive 28 which is relatively fluid or slightly flowable in its original state has in the hardened state a density of between 1,000 to 1,200 kg/m$^3$, preferably of about 1,100 kg/m$^3$, and a hardness of between 60 to 90 Shore D, preferably about 70 Shore D. The particularly efficient or economic hardening of the filler and adhesive 28 is also achieved by a filler and adhesive 28 with a basis of polyols and isocyanates to be mixed.

In this way it is achieved that the sliding board body 3 or one-piece composite body 4 to be produced can be removed from the pressing device 45 or can be demolded from the mold 46, 47 after an initial reaction or hardening time of the filler and adhesive 28 of between 1 min and 20 min, preferably between 2 min and 10 min, in particular between 3 min and 5 min, without the risk of delamination.

According to a further measure the sliding board body 3 or the one-piece composite body 4 to be produced is stored without stress and tension at about room temperature after removal from the pressing device 45 and in this case the hardening time of the filler and adhesive 28 is completed prior to further processing of the multilayered sandwich element, in particular prior to a grinding or cutting processing of boundary surfaces of the sliding board body 3. During such a grinding, cutting or chipping process for example the longitudinal side walls 26, 27 of the composite body 4 is provided with trapezoidally inclined longitudinal side surfaces 14, 15 relative to the running surface coating 11 or slightly inclined in the direction of the core element 7, as shown in FIG. 2 by solid lines or illustrated in FIG. 4 by dashed lines. The inclination of said longitudinal side surfaces 14, 15 of the sliding board body 3 relative to a vertical plane is preferably between 2° and 6°, preferably about 4°.

The exemplary embodiments show possible embodiment variants of a ski 1, a semi-finished product 40 and production methods relating thereto, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field. Thus all conceivable embodiment variants, which are made possible by combining individual details of the embodiment variants shown and described, are also covered by the scope of protection.

Finally, as a point of formality, it should be noted that for a better understanding of the production processes or structures the latter and their components have not been represented true to scale in part and/or have been enlarged and/or reduced in size.

The problem addressed by the independent solutions according to the invention can be taken from the description.

Mainly the individual embodiments shown in FIGS. 1, 2; 3; 4; 5 can form the subject matter of independent solutions according to the invention. The objectives and solutions according to the invention relating thereto can be taken from the detailed descriptions of these figures.

List of Reference Numerals

| | |
|---|---|
| 1 | ski |
| 2 | binding device |
| 3 | sliding board body |
| 4 | composite body |
| 5 | upper strap |
| 6 | lower strap |
| 7 | core element |
| 8 | upper side |
| 9 | cover layer |
| 10 | lower side |
| 11 | running surface coating |
| 12 | edge element |
| 13 | edge element |
| 14 | longitudinal side surface |
| 15 | longitudinal side surface |
| 16 | flat side |
| 17 | flat side |
| 18 | side surface |
| 19 | side surface |
| 20 | base side |
| 21 | length |
| 22 | base side |
| 23 | length |
| 24 | intermediate space |
| 25 | intermediate space |
| 26 | longitudinal side wall |
| 27 | longitudinal side wall |
| 28 | filler and adhesive |
| 29, 29' | side cheek element |
| 30, 30' | side cheek element |
| 31 | inner surface |
| 32 | inner surface |
| 33 | cross-sectional width |
| 34 | wedge angle |
| 35 | band |
| 36 | opening |
| 37 | connecting channel |
| 38 | layer |
| 39 | layer |

-continued

List of Reference Numerals

| | |
|---|---|
| 40 | semi-finished product |
| 41 | wooden lamella |
| 42 | longitudinal side edge |
| 43 | longitudinal side edge |
| 44 | cross-sectional width |
| 45 | pressing device |
| 46 | mold |
| 47 | mold |

The invention claimed is:

1. A ski or snowboard comprising:

a multilayered sliding board body with at least one strength-providing upper strap, at least one strength-providing lower strap, and at least one strip-like core element arranged in between the upper strap and the lower strap, wherein the strip-like core element is delimited essentially by a first and a second flat side and by lateral side surfaces, and which core element has at least in sections of its longitudinal extension an essentially trapezoidal cross section with a first base side, a first length and a second base side essentially parallel thereto with a second, comparatively shorter length, at least one cover layer forming the upper side of the sliding board body and at least one running surface coating forming the lower side of the sliding board body, wherein the first flat side of the core element with the first base side that is comparatively longer in cross section is assigned closest to the strength-providing upper strap and the second flat side with the second base side that is comparatively shorter in cross section is assigned closest to the strength-providing lower strap.

2. The ski or snowboard as claimed in claim 1, wherein an intermediate space filled at least largely with filler and adhesive broadens between at least one longitudinal side wall of the sliding board body and the side surface of the core element closest to said longitudinal side wall from the upper strap of the sliding board body in the direction of its lower strap in relation to the cross section of the sliding board body.

3. The ski or snowboard as claimed in claim 1, wherein at least one section is formed by at least one longitudinal side wall of the sliding board body by at least one strip-like side cheek element, the inner surface of which facing the core element with the closest side surface of the core element defines an intermediate space filled at least largely with filler and adhesive, wherein said intermediate space widens from the upper strap of the sliding board body in the direction of its lower strap in relation to the cross section of the sliding board body.

4. The ski or snowboard as claimed in claim 2, wherein the intermediate space which is essentially wedge-shaped in cross section and is filled at least largely with the filler and adhesive is designed in its upper end section closest to the upper strap to be obtuse, and has in particular a cross-sectional width between 0.5 mm and 5 mm.

5. The ski or snowboard as claimed in claim 2, wherein the inner surface of the longitudinal side wall and/or the inner surface of the strip-like side cheek element with the closest side surface of the core element encloses a wedge angle of between 5° and 30°.

6. The ski or snowboard as claimed in claim 2, wherein the inner surface of the longitudinal side wall and/or the inner surface of the at least one strip-like side cheek element and closest side surface of the core element are roughened by a surface treatment, in particular an abrasive surface treatment, before said surfaces come into contact with the filler and adhesive, so that an improved adhesive connection is formed with the filler and adhesive.

7. The ski or snowboard as claimed in claim 3, wherein the inner surface of the at least one strip-like side cheek element is aligned essentially at right angles to the running surface of the running surface coating.

8. The ski or snowboard as claimed in claim 3, wherein the filler and adhesive joins adhesively the edge elements laterally delimiting the core element, the at least one strip-like side cheek element, the at least one lower strap, the at least one running surface coating and the running surface coating to form a one-piece composite body.

9. The ski or snowboard as claimed in claim 8, wherein the at least one lower strap is formed by a metal band, which has a plurality of allotted openings, which openings form connecting channels between layers of filler and adhesive above and below the metal band, wherein said connecting channels are filled at least partly with the filler and adhesive.

10. The ski or snowboard as claimed in claim 2, wherein the filler and adhesive is based on a modified polyurethane system, in particular a two-component mixture of polyols and isocyanates that is free-flowing in the processing state and hardens at room temperature.

11. A method for the production of a prefabricated semi-finished product, which semi-finished product forms a component for the production of a ski or snowboard, wherein the semi-finished product is configured as a one-piece component, which comprises at least one cover layer, at least a portion of a strength-providing upper strap, and at least one core element joined adhesively to the lower side of the strength-providing upper strap, which core element is configured to be strip-like and is delimited essentially by a first and second flat side and by lateral side surfaces, and which core element is arranged in relation to a finally produced sliding board body in the form of a ski or snowboard between its strength-providing upper strap and its strength-providing lower strap, and which core element has at least in sections of its longitudinal extension an essentially trapezoidal cross section with a first base side, a first length and a second base side essentially parallel thereto with a second, comparatively shorter length, and which semi-finished product is joined in a subsequent method step to additional components for the completed sliding board body, such additional components including the running surface coating and strength-providing lower strap, wherein the core element is aligned in relation to the lower side of the strength-providing upper strap such that the first flat side of the core element with the first base side that is comparatively longer in cross section is assigned closest to the strength-providing upper strap, so that the lower side of the core element facing away from the strength-providing upper strap is formed by the second flat side with the second base side which is shorter by comparison in the cross section of the core element.

12. The method as claimed in claim 11, wherein the semi-finished product comprises at least one strip-like side cheek element, which prior to the joining of the semi-finished products to the additional components of the finished sliding board body becomes an adhesively bonded component of the prefabricated semi-finished product, wherein the at least one strip-like side cheek element is provided, in order to form at least one section of at least one longitudinal side wall of the final sliding board body, in that the at least one strip-like side cheek element is adhered to at least one longitudinal side edge of the cover layer or to the upper strap arranged on the lower side of the cover layer.

13. The method as claimed in claim 12, wherein between at least one strip-like side cheek element and the core element an intermediate space is formed which is essentially wedge-shaped in cross section and is filled at least mostly with filler and adhesive, which space is delimited in relation to the width direction of the sliding board body by the inner surface facing the core element of the at least one strip-like side cheek element and by the closest assigned side surface of the core element.

14. The method as claimed in claim 13, wherein at least the inner surfaces of the at least one strip-like side cheek element and the side surfaces of the core element are roughened before the intermediate spaces formed in between are filled with the filler and adhesive.

15. The method as claimed in claim 14, wherein the roughening is performed by means of an abrasive surface treatment method, the abrasive surface treatmond method including a sandblasting method.

16. The method as claimed in claim 13, wherein the cross-sectional width of the at least one intermediate space which is wedge-shaped in cross section is increasingly larger from the end section closest to the upper strap in the direction of the end section closest to the lower strap.

17. The method as claimed in claim 13, wherein a smallest cross-sectional width of the intermediate space, which is essentially wedge-shaped in cross section, is defined in its end section closest to the upper strap to be between 0.5 mm and 5 mm.

18. A semi-finished product which forms a part component for the production of a ski or snowboard, wherein the semi-finished product is configured as a one-piece part component which comprises at least one cover layer, at least one part of a strength-providing upper strap, and at least one core element adhesively connected to the lower side of the strength-providing upper strap, which core element is designed to be strip-like and is formed essentially by a first and second flat side and by lateral side surfaces and which core element is arranged in relation to a finally produced sliding board body in the form of a ski or snowboard between its strength-providing upper strap and its strength-providing lower strap, and which core element at least in sections of its longitudinal extension has an essentially trapezoidal cross section with a first base side a first length and a second base side essentially parallel thereto with a second, comparatively shorter length, and which semi-finished product is connected, in particular assembled, in a subsequent method step with additional components for the final sliding board body, such additional components including the running surface coating and strength-providing lower strap, as claimed in claim 11, wherein the assignment of the said core element to the lower side of the strength-providing upper strap such that the first flat side of the core element with the first base side, which is comparatively longer in cross section, is assigned closest to the strength-providing upper strap, so that the lower side of the core element facing away from the strength-providing upper strap is formed by the second flat side with the second base side that is comparatively shorter in cross section of the core element.

19. A method for producing a sliding board body, such as a ski or a snowboard, in which a plurality of elements comprising at least one cover layer at least one strength-providing upper strap, at least one strength-providing lower strap, at least one core element arranged between the upper strap and the lower strap, at least one running surface coating and at least one side cheek element are joined together adhesively by at least one pressing and joining process to form a one-piece composite body, wherein a semi-finished product produced according to claim 11 is prepared and said prefabricated semi-finished product, is joined adhesively by means of a pressing device and at least one mold in at least following, separate pressing cycle with the additional components of the sliding board body to be produced, such as its running surface coating and its strength-providing lower strap.

20. The method as claimed in claim 19, wherein the connection is achieved by means of a filler and adhesive with a polyurethane base which reacts at room temperature and in particular hardens at room temperature.

21. The method as claimed in claim 19, wherein the pressing cycle is designed for the adhesive bonding of the semi-finished product to the additional components of the sliding board body to be produced as a cold pressing cycle.

22. The method as claimed in claim 21, wherein no external, thermal energy or no additional heating is supplied to the pressing device or its mold during the cold pressing cycle.

23. The method as claimed in claim 19, wherein the sliding board body to be produced or the one-piece composite body after an initial reaction or hardening period of a supplied filler and adhesive of between 1 min and 20 min, is removed from the pressing device or is demolded from the mold.

24. The method as claimed in claim 23, wherein the sliding board body to be produced or the one-piece composite body is stored after removal from the pressing device at about room temperature free of stress and tension, and in this case the hardening time of the filler and adhesive is completed prior to further processing of the multilayered composite body, in particular prior to a grinding or cutting processing of the boundary surfaces of the sliding board body.

* * * * *